United States Patent [19]

Shelton

[11] 4,345,181

[45] Aug. 17, 1982

[54] EDGE EFFECT ELIMINATION AND BEAM FORMING DESIGNS FOR FIELD EMITTING ARRAYS

[76] Inventor: Joe Shelton, 700 Tatom St., SW., Huntsville, Ala. 35805

[21] Appl. No.: 155,890

[22] Filed: Jun. 2, 1980

[51] Int. Cl.[3] ..... H01J 1/02

[52] U.S. Cl. ..... 313/309; 313/336; 313/353; 313/302

[58] Field of Search ..... 313/107, 302, 306, 309, 313/336, 353

[56] References Cited

U.S. PATENT DOCUMENTS

| | | | |
|---|---|---|---|
| 3,671,798 | 6/1972 | Lees | 313/336 |
| 3,735,186 | 5/1973 | Klopfer et al. | 313/353 |
| 3,745,402 | 7/1973 | Shelton et al. | 313/309 |
| 3,746,905 | 7/1973 | Shelton et al. | 313/309 |
| 3,783,325 | 1/1974 | Shelton | 313/309 |
| 3,840,955 | 10/1974 | Hagood et al. | 29/25.18 |
| 3,859,550 | 1/1975 | Hagood et al. | 313/309 |

*Primary Examiner*—Saxfield Chatmon, Jr.
*Attorney, Agent, or Firm*—Nathan Edelberg; Robert P. Gibson; Freddie M. Bush

[57] ABSTRACT

The edge effect elimination and beam forming device uses a field effect electron emitter with a conductive material disposed over selected portions of the emitting fibers of the emitter, in electrical contact with the fibers, and in the same plane as the fiber emitting points for eliminating electron emission in the area where the conductive material is placed. For edge effect elimination the conductive material is placed over the outer emitting fibers in a continuous path or ring. For additional beam shaping other segments or sections of the emitter surface may have conductive material deposited thereon to eliminate emission from that area, thereby shaping the beam emitted from the uncovered emitting points.

7 Claims, 5 Drawing Figures

EDGE EFFECT ELIMINATION AND BEAM FORMING DESIGNS FOR FIELD EMITTING ARRAYS

DEDICATORY CLAUSE

The invention described herein may be manufactured, used, and licensed by or for the Government for governmental purposes without the payment to me of any royalties thereon.

BACKGROUND OF THE INVENTION

Electron beams in electron tubes are formed using either thermionic or field emitters as an electron gun with a control grid or anode to form the electrons to the desired shape. The electron gun and anode produce a specified number of electrons at a specified velocity for use in electron tubes such as beam power tubes. The number of electrons in the electron beam must be constant and controllable, and the energy of all the electrons must be substantially the same for efficient operation. Even small changes in emitter temperature result in changes in the electron emission. Similarly, small changes of anode voltage can affect the current. Therefore, anode potential and emitter temperature must be well regulated to provide constant current for proper operation of a thermionically controlled electron gun or electron beam forming device. A field effect electron gun and control electrode can control electron flow without thermionic emission or thermionic interference. U.S. Pat. No. 3,783,325 issued Jan. 1, 1974 to Joe Shelton discloses a field effect electron gun wherein the number of electrons emitted is a function of the electric field. The electric field which is developed between the emitter and the anode is controlled by the emitter and anode structure.

The usual approach to forming electron beams, using either thermionic or field emitters, is to use a grid to form the electrons to the desired shape. When multiple electron beams are required as for multiple beam cathode ray tubes, several individual emitting sources and control electrodes are required. This approach leads to problems due to electrons being intercepted by the grid resulting in grid heating and excessive grid current.

The maximum current density obtainable from an array or field emitting points has been limited due to edge effects. This is due to the outer emitting points seeing a larger collection area than the inner points which results in a higher electric field at the outer points. This difference in electric field causes the outer points to emit a sufficient number of electrons to damage the outer pins before the electric field reaches a sufficient value at the inner points to initiate emission. This results in a low total current and damage to the outer emitting points.

SUMMARY OF THE INVENTION

In edge effect elimination and beam forming or shaping structures for field emitting arrays, a field effect electron emitter is constructed to include a layer or layers of conducting material on the portions of the emitter wherein it is desired to prevent electron emission. For elimination of edge effect the conductive layer of material is disposed on the outer edge of the emitter array. For more advanced beam forming or shaping, additional areas of the emitter surface have a conductive layer thereon for eliminating electron emission from those areas, thereby allowing shaping of the electron emission from the increased portions of the field effect emitter. The width of the conducting material may be varied as long as the minimum width exceeds the spacing between emitting points, and the top or tip of the emitting points lies in the same plane as the conductive material. Since the surface area of the conductive material is large compared to the surface area of the point it covers, no emission will occur from the conductive material.

DESCRIPTION OF THE PREFERRED EMBODIMENT

Figure 1:
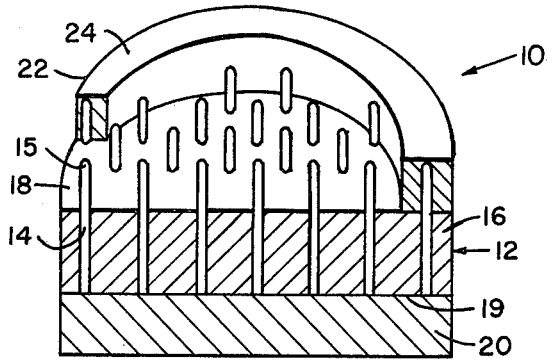
FIG. 1 is a perspective view partially cut-away, of a field effect emitter with a conductive material disposed to eliminate edge effects.

Various techniques exist in the prior art for the production of conventional electron beams using thermionic and field effect emitters. These techniques deal with the use of shaped grids and are limited in the number of configurations possible, being essentially limited to solid and hollow beams generally shaped by the grid shape.

The field effect electron emitter is an oxide-metal matrix which comprises ordered metal fibers separated by insulating oxide. The metal fibers are more than a million and may be several million emitting fibers arranged in parallel for each square centimeter of surface area with the ends of the fibers forming the emitter surface. The distance between adjacent fiber ends is substantially the same and the fiber ends are all of substantially the same diameter. Typically, the emitter composite is a conventional composite described in U.S. Pat. No. 3,745,402 issued July 10, 1973 to Joe Shelton et al. Methods for producing a control device using field effect emitters is disclosed in Pat. No. 3,840,955 issued Oct. 15, 1974 to Jerry W. Hagood et al and disclosed typical methods of depositing material on the emitter and the exposing of fibers.

With reference to field emitters, the basic equation for single point field emitters has been developed by experimental data as have been noted by Dyke, W. T. and W. W. Dolan, in "Field Emission", Advances in Electronics and Electron Physics, volume VIII, edited by L. Martin, Academic Press, Incorporated, New York, New York, 1956. In its basic form, which can be quickly derived by considering concentric spheres, the equation can be written as:

$$F=Kv/r \quad (1)$$

where K=constant, v=potential, r=radius of the emitter, and F=electric field. This basic equation can also be written as:

$$F = K \frac{\sqrt{Ac}\,\sqrt{Ae}}{4\pi r^2} \frac{v}{a} \quad (2)$$

Where Ac=area of collector, Ae=area of emitter, and a=distance between collector and emitter.

Since $4\pi r^2$=Ae, equation 2 becomes $$F = K_1 \frac{\sqrt{Ac}}{\sqrt{Ae}} \frac{v}{a}. \quad (3)$$

Assuming that Ac is the area of the collector associated with the point directly under this area, equation (3) can be written as:

$$F = K_2 \frac{v}{a} \frac{l}{d} \quad (4)$$

where 1=spacing between points for multiple emitting points and d=emitting point diameter.

Consideration of equation (4) in conjunction with the sharp variations in current density with small changes in electric field leads to the following conclusions concerning the material: the emitting points must be uniformly spaced, the emitting points must all have essentially the same height and diameter, and the diameter must be very small in order to operate at reasonable potentials.

The equation shows that severe edge effects will be encountered if a collector is larger than the emitting array, and that the edge effects will be more severe as the spacing is increased. This is due to the larger collector area seen by the outer most emitting points and the larger electric field present at these points. This effect can easily result in a field sufficient to damage the outer points before the field at the inner points reaches a value capable of producing emission.

Because of the very close spacing between the emitting points, a few microns, even very small extensions of the collector beyond the emitter array will result in a sharp increase in the electric field and thus a very sharp increase in current from the outer emitting points. By reducing the collector size such that it is smaller than the emitting array a sharp decrease in the electric field at the points not directly below the collector will result and also results in little current flow from these points. This allows the field to be increased such that all emitting points below the collector contribute to the observed current and not just a narrow ring directly below the edge of the collector. Care must be exercised to insure that the electric field is uniform across the entire array of emitting points.

Since it is often impractical or not possible to make the collector smaller than the emitter array for a majority of applications, a layer of conducting material placed on the outer edge of the emitter array at approximately the same level or plane as the emitting points can prevent emission of electrons and thereby eliminate the edge effect while allowing the collector size to be undisturbed.

Referring now to the drawings wherein like numbers refer to like parts in the several figures, FIG. 1 is an emitter assembly 10 for edge effect elimination and beam shaping. Assembly 10 comprises a metal-oxide composite 12 which is a field effect electron emitter having parallel emitting fibers 14 arranged in an insulating oxide 16. Electron emitting ends or points 15 of fibers 14 are raised above the surface 18 of the composite oxide. A conductive backing plate 20 is deposited on the rear surface 19 of the composite for providing electrical connection between the conductive fibers and external circuitry. This forms a basic field effect electron emitter array as taught by Shelton et al. in U.S. Pat. No. 3,745,402. A conductive material 22 is placed on the outer edge of the array. Conductive material 22 may be molybdnum, nickle, copper or any other material that can be deposited, such as by vapor deposition and is compatable with vacuum tube environments. The material 22 has a surface 24 which is approximately the same height as the emitting points 15 and therefore lie in a common plane. Conductive material 22 forms a ring or complete path around the outer primeter of surfaces 18, encompassing the outer or peripheral emitting fibers 14 in the ring. The width of the conductive ring is variable, allowing containment of any size array and is critical only in that the minimum width must exceed the spacing between adjacent emitting points such that the portion of electric field concentrated on the ring is insufficient to emit electrons at the potential which allows the uncovered emitting points 15 to emit electrons.

Figure 2:
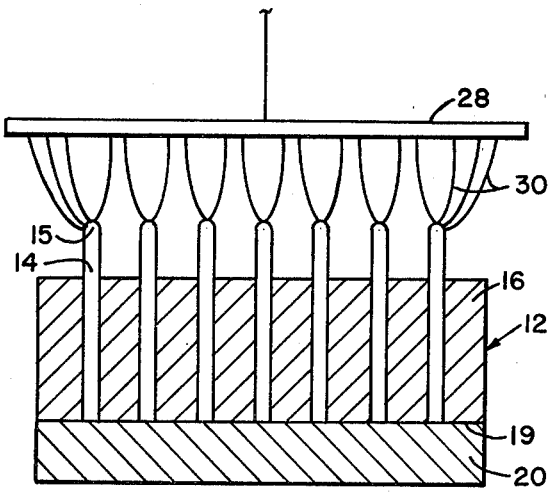
FIG. 2 is a cutaway view of a field emitter showing a single row of emitting fibers with typical electronic field concentration.

FIG. 2 shows a typical metal-oxide composite 12 with a collector 28 disposed in a plane parallel to the plane of emitting points 15 for collecting electrons emitted by the emitting fibers 14. Typical concentration of electric field lines 30 exist between the emitting points and collector anode 28. The field 30 concentration is heavier on the outer emitting points as shown by the greater number of field lines 30 on these points. The inner points 15 have a uniform field distribution. While this characteristic of electric fields is well established it can be readily observed with a simple electrolytic tank having a large surfaced collector at one end and a field effect electron emitter as the other end with a potential developed thereacross. Even more simply, the emitter can be replaced by a group of parallel equally spaced rods or conductors representative of the minute fibers 14 for observing the field line.

Figure 3:
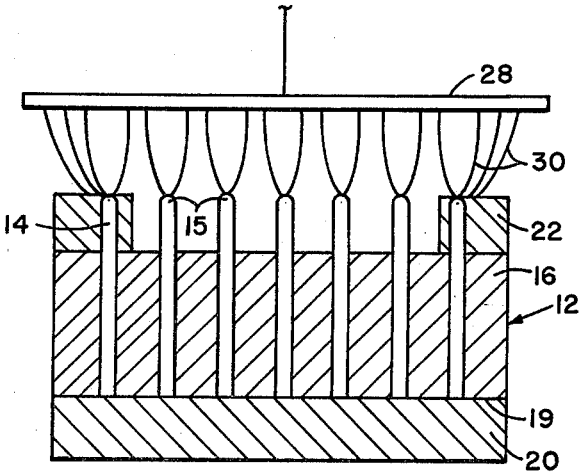
FIG. 3 is a cutaway view showing a row of emitting fibers and a conductive layer controlling the electric field concentration.

FIG. 3 shows a typical metal-oxide composite 12 with collector 28 and backing plate 20 for developing a potential thereacross. Conducting material 22 in the form of a ring covers the outer fibers 14 allowing the field between collector 28 and ring 22 to be dispersed over a large area, preventing conduction therebetween at the same voltage that allows electrons to be drawn from the exposed emitting points 15. This results in uniform conduction from the inner, exposed emitting points due to the uniform field developed thereon. Thus, edge effect breakdown of the emitters is eliminated, uniform electron emission is obtained and the beam is shaped and bounded by the conductive material ring 22.

Figure 4:
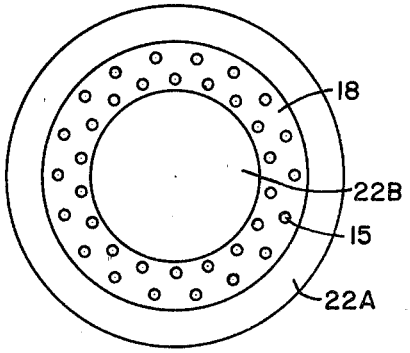
FIG. 4 is a plan view of a field effect emitter having conductive material placed to produce a hollow electronic beam.
Figure 5:
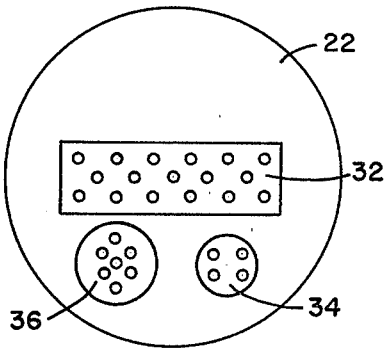
FIG. 5 is a plan view of a field effect emitter having conductive material disposed thereon to provide multiple beams from a single emitting array.

FIGS. 4 and 5 are plan views of typical metal-oxide composites wherein the conductive material provides boundries on all sides of the exposed emitting fibers for controlling the shape of the electron beam emitted when utilized in a conductive environment where a voltage and field are developed between a collector and the emitter. Typically, FIG. 4 shows an outer conductive layer 22A which prevents edge effect breakdown and controls the outer beam shape. An inner conductive layer 22B provides an inner beam boundry. In operation the emitter provides a hollow electron beam. Since the surface area of the conductive layers 22A and 22B are large compared to the surface area of the points they cover, no emission occurs from the conducting material layers. Similarly, FIG. 5 shows a single conductive layer 22 arranged to provide an electron sheet beam from exposed emitter array surface 32 and a pair of cylindrical electron beams from the circular exposed array surfaces 34 and 36 respectively. Obviously multiple and complex electron beams may be easily formed and produced from a single array.

In addition to elimination of edge effects and providing beam forming, the array structure with selected conductive layers that prevent emission also allow the use of a large collector area. This large collector area structure is required for proper operation of many devices. While the structure is simple and rugged, it provides an easy technique for forming complex and multiple beams from single emitting arrays.

Theoretically, a conductive ring may be placed around the circumference of a field effect and attached to the backing plate conductor to accomplish elimination of edge effect destruction. In practice, however, due to the extremely close spacing of the conductive fibers and mechanical spacing tolerance factors, this is not practical. Too much spacing at any point around the edge of the emitter will cause the field at that point to be increased and thereby cause excessive conduction at that point, resulting in failure of the device. Therefore depositing the conductive ring on the emitter surface results in a simple, readily constructed embodiment.

While the invention has been described in connection with certain specific embodiments thereof, it will be understood that other modifications will suggest themselves to those skilled in the art and that it is intended to cover such modifications that fall within the scope of the claims appended hereto.

I claim:

1. An electron emitter assembly for electric field electron emission comprising: a field effect electron emitter composite having a plurality of minute, elongated, parallel, conductive fibers; an insulation filler, each fiber being insulated from and held substantially equidistant from adjacent fibers by said insulation; each fiber having first ends thereof terminated in a plane for emitting electrons therefrom, said first ends extending a uniform distance beyond the surface of said insulation for providing electron field emission; and a conductive backing plate in common with the second end of each of said fibers for conveying an electrical potential thereto; and a conductive material covering selected ones of said fiber first ends for preventing electric field emission from said covered fibers when the remaining uncovered fibers are emitting electrons.

2. An electron emitter assembly as set forth in claim 1 wherein said conductive material has a minimum width which exceeds the spacing between adjacent emitting points for preventing electron emission from said conductive material at preselected electric fields.

3. An electron emitter assembly as set forth in claim 2 wherein said conductive material has selective, variable width and length for selectively covering surface portions of said field effect electron emitter to circumscribe multiple emitter surface areas and thereby providing geometric shaped boundaries for forming the shape of electron emission therefrom.

4. An electron emitter assembly as set forth in claim 1 wherein said conductive material covers the outermost emitting fibers, forming a continuous, unbroken ring having a minimum width which exceeds the spacing between emitting points such that an electric field concentrated on the ring will not be of sufficient intensity to allow electron emission while the inner, uncovered fibers will emit electrons.

5. An electron emitter assembly as set forth in claim 4 wherein said conductive material lies in substantially the same plane and is parallel with the plane formed by the emitting points of said fiber first ends.

6. A field effect, electron beam forming device comprising a field effect electron emitter, said emitter having a plurality of conductive fibers in an electron emitting surface, said fibers being disposed in parallel, insulation encomposing, supporting, and uniformly spacing said fibers apart, respective first ends of said fibers projecting above the surface of said insulation, said ends forming a planar emitting surface for emitting electrons therefrom, respective second ends of said fibers being adapted for electrical contact for supplying an electrical potential thereto; a conductive material in electrical contact with and covering selected ones of said fiber first ends for preventing electric field effect emission from said covered fibers when the remaining fibers are emitting electrons, and a collector remotely disposed in a plane parallel with said planar emitting surface for developing an electric field therebetween and receiving electrons emitted by said fiber first ends.

7. A field effect, electron beam forming device as set forth in claim 6 wherein said conductive material lies in the same plane as the plane formed by the electron emitting first fiber ends and has a variable width, said conductive material width having a minimum width sufficient for preventing electron emission from said conductive material at predetermined electric fields at which said uniformly spaced fibers emit electrons for controlling and shaping electron beam emission.

* * * * *